US005540275A

United States Patent [19]

Eisinger

[11] Patent Number: 5,540,275

[45] Date of Patent: Jul. 30, 1996

[54] SINGLE IMPACT RAPPING HAMMER SYSTEM AND METHOD FOR CLEANING TUBE UNITS

[75] Inventor: Frantisek L. Eisinger, Demarest, N.J.

[73] Assignee: Foster Wheeler Energy Corporation, Clinton, N.J.

[21] Appl. No.: 405,654

[22] Filed: Mar. 17, 1995

[51] Int. Cl.[6] ..... F28G 7/00

[52] U.S. Cl. ..... 165/84; 165/95; 15/104.07; 15/104.04; 122/361; 173/122; 173/211; 173/124

[58] Field of Search ..... 165/95, 84; 122/379, 122/361; 15/104.07, 104.04; 173/124, 122, 205, 210, 211

[56] References Cited

U.S. PATENT DOCUMENTS

| | | | |
|---|---|---|---|
| 1,275,009 | 8/1918 | Eriksson | 15/104.07 |
| 3,835,817 | 9/1974 | Tuomaala | 122/379 |
| 5,135,966 | 5/1994 | Gamache et al. | 165/84 X |

FOREIGN PATENT DOCUMENTS

| | | | |
|---|---|---|---|
| 85784 | 10/1921 | Austria | 15/104.07 |
| 44471 | 8/1918 | Sweden | 15/104.07 |

*Primary Examiner*—John Rivell
*Assistant Examiner*—Christopher Atkinson
*Attorney, Agent, or Firm*—Charles L. Willis, Esq.

[57] ABSTRACT

A rapping hammer system adapted for periodically rapping and cleaning tubes of a heat exchanger unit to remove undesired deposits from outside the tubes. A plurality of rapping hammers are each pivotably attached to a radial arm extending outwardly from and spaced apart along a rotatable shaft. A spring device is attached to each radial arm and arranged to contact the rapping hammer with sufficient force so as to substantially restrain repeated striking movements of the rapping hammer against an impact stem of the heat exchange unit following an initial impact of the hammer. A method is also disclosed for operating the rapping hammer system for periodically rapping and cleaning the outside surface of heat exchanger tubes such as boiler tubes of accumulated ash and soot deposits.

14 Claims, 4 Drawing Sheets

SINGLE IMPACT RAPPING HAMMER SYSTEM AND METHOD FOR CLEANING TUBE UNITS

BACKGROUND OF INVENTION

This invention pertains to a rapping hammer system adapted for providing single mechanical impacts on tube units for periodically removing accumulated outside deposits from multiple tubes, such as from boiler tube units, and includes a method for operating the rapping hammer system.

Cleaning of outside surfaces of heat exchanger tubes such as boiler tubes to remove accumulated ash and other deposits has been accomplished by utilizing various tube rapping means or systems. Such rapping systems usually consist of a series of hammers which impact upon a bar or header physically connected to the tubes being cleaned. Such impacting or rapping of the hammers excites tube vibrations, which results in a tube cleaning action for substantially removing deposits accumulated on the tubes. Relatively high input energies are needed for impacting the tube headers to sufficiently excite the tubes and thereby provide an adequate cleaning action. Typical maximum acceleration imposed upon the tube headers are in the range of up to 200 g's, resulting in maximum tube acceleration of 25 g to 100 g's required for proper cleaning, depending upon the type of deposits on the tubes.

The tube rapping procedure is usually performed in several rapping cycles, so that within one cycle several headers located in close proximity and typically parallel to each other are sequentially rapped, say in a sequence of 1, 2, 3, . . . n, etc., where n is the total number of headers and/or impact bars. Each header/impact bar is rapped by one hammer and thus the number of hammers required equals the number of header/collection bars included in a heat exchanger installation. In a typical rapping hammer system, all the hammers are connected to and driven by a common shaft and are spaced apart according to the spacing of the headers. The impacting of the hammers on the headers is typically arranged in distinct time intervals, so that no two hammers will impact upon the headers at the same time for reasons of dynamic interaction effects, which could reduce the cleaning effectiveness of the rapping procedure on the headers. Typical examples of such conventional mechanical rapping hammer systems are disclosed by Tuomaala U.S. Pat. No. 3,835,817 and Gamache et al. U.S. Pat. No. 5,315,966.

In a typical rapping hammer arrangement, the hammers are rotatably attached to a common shaft and when the hammers are rotated into their upper position they will fall and impact upon the header/collection bars by effect of gravity. Typically, the hammer will rotate from a near upright (upper) position to its lowermost vertical position and strike the header horizontally by way of an impact stem which is attached to the header/impact bar. After impacting the hammer, the hammer usually rebounds and immediately strikes the header again, then rebounds and strikes the header again, etc. until the energy of impact is gradually dissipated. The hammer typically impacts the header stem 3, 4 and more times in very short time intervals, before it is rotated away and raised for the next series of impacts on the header. However, because the tube cleaning effect by such rapping of the headers is achieved mainly on the first large or major impact of the hammer against the header, and not by the subsequent repeated smaller or minor impacts which follow and are usually undesirable for effective tube cleaning, improved rapping hammer systems are desired.

SUMMARY OF INVENTION

The object of the present invention is to provide a hammer rapping system for impacting and outside cleaning of tubes of heat exchanger units such as steam boilers, which system effectively eliminates the usual additional repeated smaller impacts by the rapping hammer following its first major impact against a tube header. By appropriate analysis and testing, it has now been discovered that such additional smaller hammer impacts on tube units, which are due to repetitive rebounding of the rapping hammer, are detrimental to the tube cleaning process and reduce the tube cleaning efficiency. The first major hammer impact desirably excites vibrations in the heat exchanger header and thereby excites the tubes to produce external surface cleaning. However, subsequent smaller impacts of the rapping hammer, if not minimized or preferably eliminated entirely, will interfere with the desired vibratory motion already in effect from the hammer first major impact and will reduce or even stop the vibratory motions altogether, thus substantially neutralizing and defeating the purpose of the first impact excitation. The subsequent uncontrolled hammer impacts thus undesirably reduce the tube cleaning effectiveness of a rapping hammer system and should be eliminated.

The rapping hammer system according to the present invention consists of an elongated rotatable shaft having a plurality of radial arms rigidly attached to but spaced apart from each other along the shaft length, each radial arm being at a successively increasing circumferential angle relative to the preceding adjacent radial arm, with a rapping hammer unit including an elongated bar being pivotably attached to each radial arm. A spring device such as a compression or leaf spring is attached rigidly to each radial arm and so that one end of the spring device can bear against the hammer bar. The spring device operates to interfere with and restrain subsequent swinging motions of the rapping hammer in the direction of its first main impact against an impact member of the tube unit, but does not interfere with the subsequent rebound motions of the hammer. The position of the contact point between the spring device and the hammer bar is adjustable by a spacer means which determines the desired spring rate of the spring device against the hammer bar. For proper functioning of the spring device, the spring characteristics (spring rate) as measured at the location of hammer impact point will be a function of hammer weight and arm length. A spring rate range of between 100 lb./in and 500 lb./in is suitable for proper functioning of the system.

This invention also includes a method for cleaning external surfaces of multiple tube units of accumulated deposits by utilizing the rapping hammer system to strike a tubular heat exchanger unit so as to produce vibrations which remove external deposits from the tubes.

BRIEF DESCRIPTION OF DRAWINGS

This invention will be further described with reference to the following drawings, in which.

DESCRIPTION OF INVENTION

Figure 1:
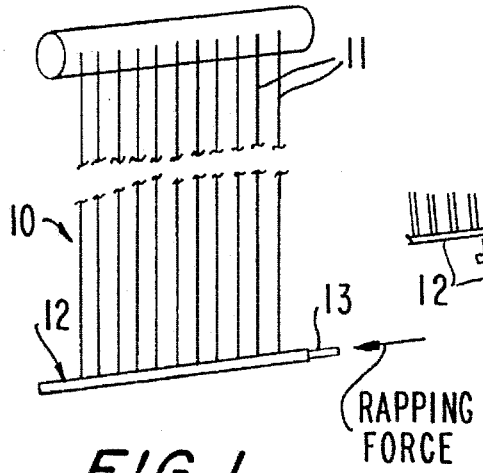
FIG. 1 shows schematically a heat exchanger tube unit having a common header and impact stem rigidly attached to the lower end of the tube unit.
Figure 2:
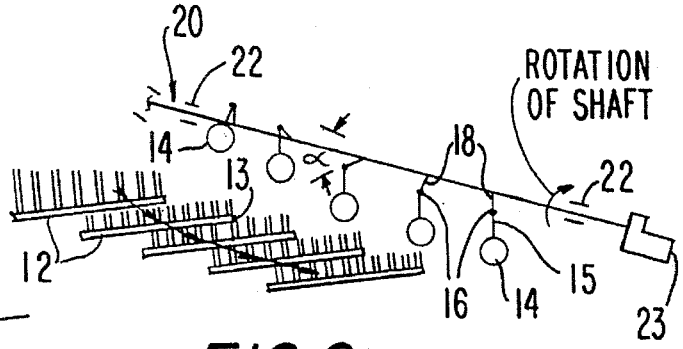
FIG. 2 shows schematically the arrangement of the heat exchanger multiple lower header impact headers each aligned with a rapping hammer pivotably attached at successively increased circumferential angles to a common elongated rotatable shaft according to the invention.

As shown by FIGS. 1 and 2, a heat exchange tube unit 10 has multiple tubes 11 which are each attached at its lower end to a header 12 having a header impact stem 13 which is either attached rigidly onto the header at one end of the header or is externally guided and in contact with the header. The impact stem 13 is arranged to be struck at one end 13*a* by a rapping hammer 14. As shown, a plurality of the headers 12 and impact stems 13 each has a rapping hammer 14 aligned with each header impact stem. The rapping hammers 14 each have an elongated bar 15 pivotably attached at 16 to a radial arm 18, a plurality of which are spaced apart along the length of an elongated rotatable shaft 20. As shown by FIG. 2, each radial arm 18 extends radially outwardly from the shaft 20, and each successive adjacent radial arm 18 is oriented at a circumferential angle $\alpha$ of 20°–60° greater than the preceding adjacent radial arm 18 spaced apart along the shaft. The rotatable shaft 20 is rotatably supported by at least two stationary bearings 22 which are spaced apart from each other and is rotated by gear-motor unit 23 connected to one end of the shaft.

Figure 3:
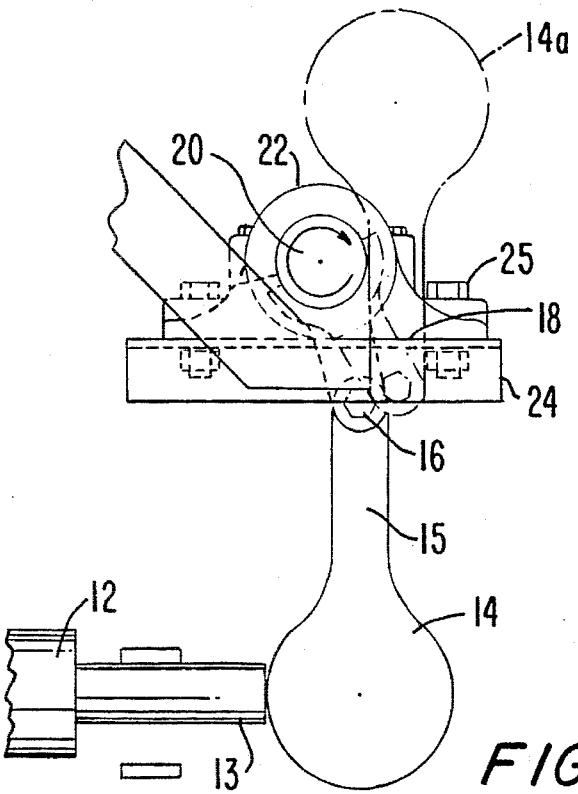
FIG. 3 shows a cross-sectional elevation view of a single rapping hammer and its rotatable driving shaft arrangement.

As shown in greater detail by FIG. 3, the elongated rotatable shaft 20 is mounted in the bearings 22 which are each rigidly mounted onto a stationary support 24 by suitable fasteners 25 such as bolts. It will be apparent from this construction that when the shaft 20 is rotated in the bearings 22, each rapping hammer 14 along with its elongated bar 15 is lifted by its radial arm 18 to a position above the shaft axis. Then, as the shaft 20 is further rotated, the rapping hammer 14 and elongated bar 15 will fall rapidly by gravity force from its uppermost position 14*a* to its lowermost position at which it strikes the end 13*a* of header impact stem 13 at a high impact velocity. It will be apparent that when the hammer 14 falls its rotary velocity will exceed the rotary velocity of radial arm 18 attached to shaft 20. Such hammer impact produces vibrations within the tube header 12 and multiple tubes 11, so as to effectively dislodge and remove accumulated deposits such as ash and scale from the tubes.

Figure 4D:
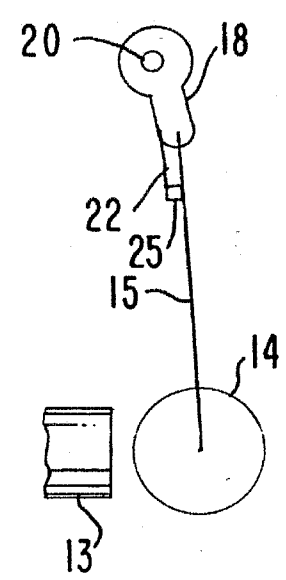
FIG. 4*d* shows the hammer usual repeat impact motion being restrained by the spring device and thereby prevented from repeatedly impacting upon the header stem following rebound of the hammer.
Figure 4C:
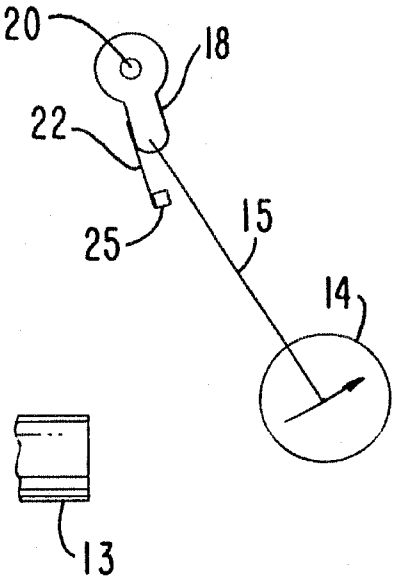
FIG. 4*c* shows the rapping hammer after rebounding following its initial impact on the header impact stem.
Figure 4B:
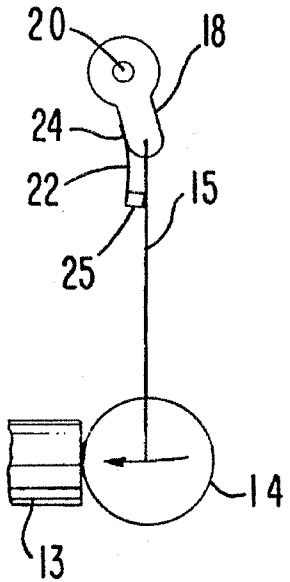
FIG. 4*b* shows the rapping hammer and spring device position at the instant of the hammer impact against the header impact stem.
Figure 4A:
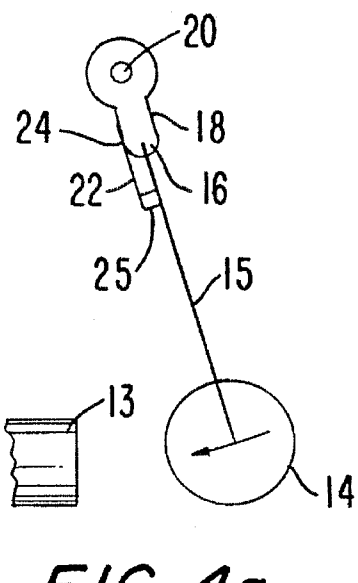
FIG. 4*a* shows schematically the rapping hammer shaft and the hammer arm with its mounted spring device just before impact of the hammer against a tube header impact stem according to the invention.

Operations of the single impact rapping hammer system according to the invention is generally shown by FIGS. 4*a*–4*d*. As shown by FIG. 4*a*, the rapping hammer 14 with its elongated bar 15 pivotably attached at 16 to radial arm 18 is rotated about shaft 20 and swings by gravity action toward the impact stem 13 of lower header 12. A spring device 26 is rigidly attached at 27 to the radial arm 18, and has the spring outer end 28 bearing against the elongated bar 15. As shown in FIG. 4*b*, rapping hammer 14 has fallen rapidly by effect of gravity and struck the header impact stem 13 and the hammer bar 15 has initially compressed or deflected the spring device 26, while radial arm 18 has been further rotated only incrementally by the rotary shaft 20. FIG. 4*c* shows the rapping hammer 14 and its elongated bar 15 have rebounded after initially striking the header impact stem 13, so that the elongated bar 15 has moved away from contact with the outer end 28 of the spring device 26. Finally, FIG. 4*d* shows the hammer 14 repeat rapping motion against header impact stem 13 being restrained by the spring device 26 according to the invention, so that the hammer 14 does not repeatedly and undesirably strike against the impact stem 13 of lower header unit 12 following the hammer rebound as was shown by FIG. 4*c*.

The desired spring constant for the spring device 26 is related to the hammer weight and velocity and force of its initial impact against the header stem 13. During the initial main impact of the rapping hammer 14, the spring device 26 will be initially deflected by the hammer bar 15. But following the initial rebound of hammer 14 per FIG. 4*c*, the spring rate of the device 26 must be sufficient to substantially prevent subsequent impacts of the hammer against the heat exchanger header stem 13. For a hammer length of 10–20 inches and a hammer unit weight of 20–40 pounds, a spring rate of 100–500 pounds per inch of spring stiffness related to hammer-stem impact point is suitable to dampen and substantially prevent subsequent impacts of the rapping hammer 14 following its initial large impact against the header impact stem 13.

Figure 5D:
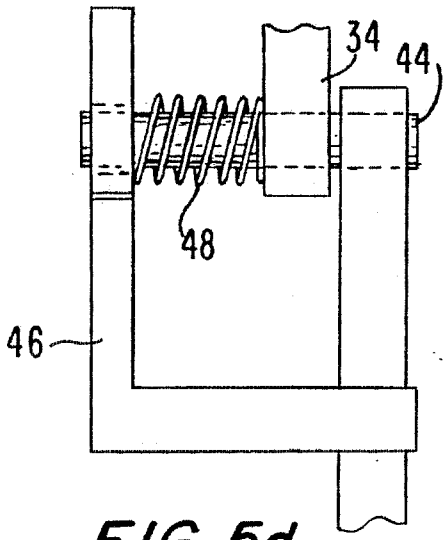
FIGS. 5*a*, 5*b*, 5*c* and 5*d* show useful alternative spring device configurations according to the invention.
Figure 5C:
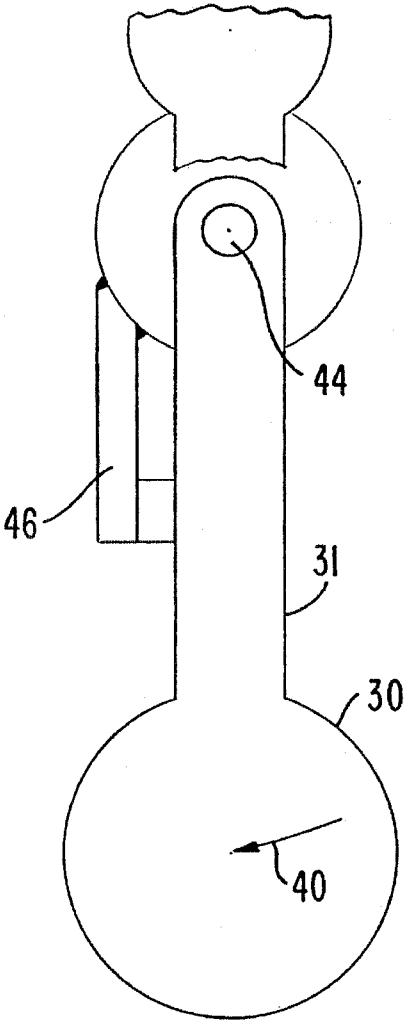
Figure 5B:
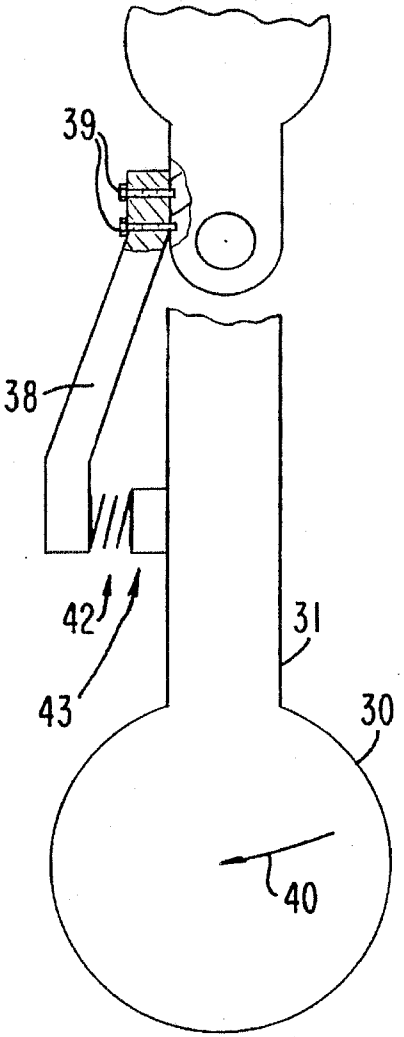
Figure 5A:
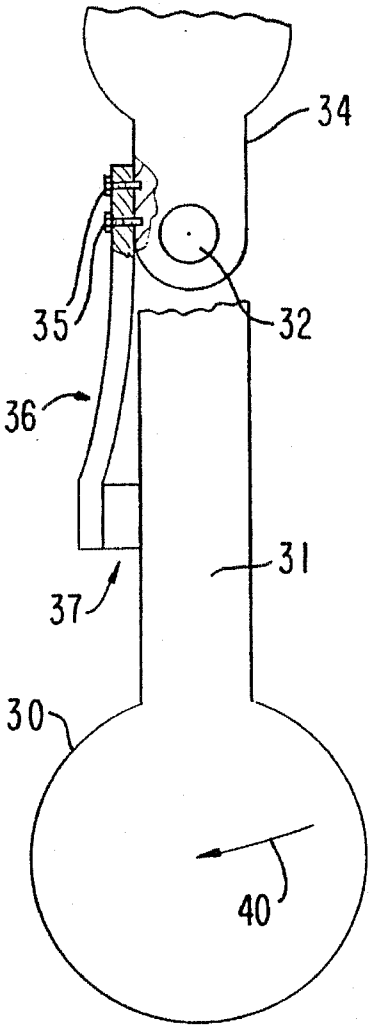

Various alternative spring devices useful for the invention are shown in greater detail by FIGS. 5*a*, 5*b* and 5*c*. FIG. 5*a* shows hammer 30 and its elongated bar 31 used with a leaf type spring 36. The hammer bar 31 is pivotably attached at 32 to rotatable radial arm 34. The leaf type spring 36 is rigidly attached by suitable fasteners 35 such as screws to the radial arm 34, and the spring 36 is initially deflected or loaded by a spacer element 37 so as to apply a variable force against the hammer bar 31 to restrain its movement in a direction of arrow 40 towards the spring.

FIG. 5*b* shows a configuration similar to FIG. 5*a* except the leaf spring member 38 attached to radial arm 34 is made substantially rigid, and a helical compression type spring 42 is provided along with a spacer element 43. The spring rate of leaf spring 38 and compression spring 42 are selected so as to restrain the hammer 30 from making subsequent impacts against the exposed end of impact stem 13.

Another alternative configuration is shown by FIGS. 5*c* and 5*d*, in which hammer bar 31 is pivotably attached to radial arm 34 by elongated pin 44. An L-shaped restraining member 46 is also pivotably mounted onto the elongated pin 44, and is connected to radial arm 34 by a helical or torsion type spring 48, so that the spring restrains movement of the hammer 30 in the direction of arrow 40. As explained above, the spring rate of torsion spring 48 is selected so as to substantially prevent the hammer 30 from making repeated strikes on the impact stem 13.

Figure 6:
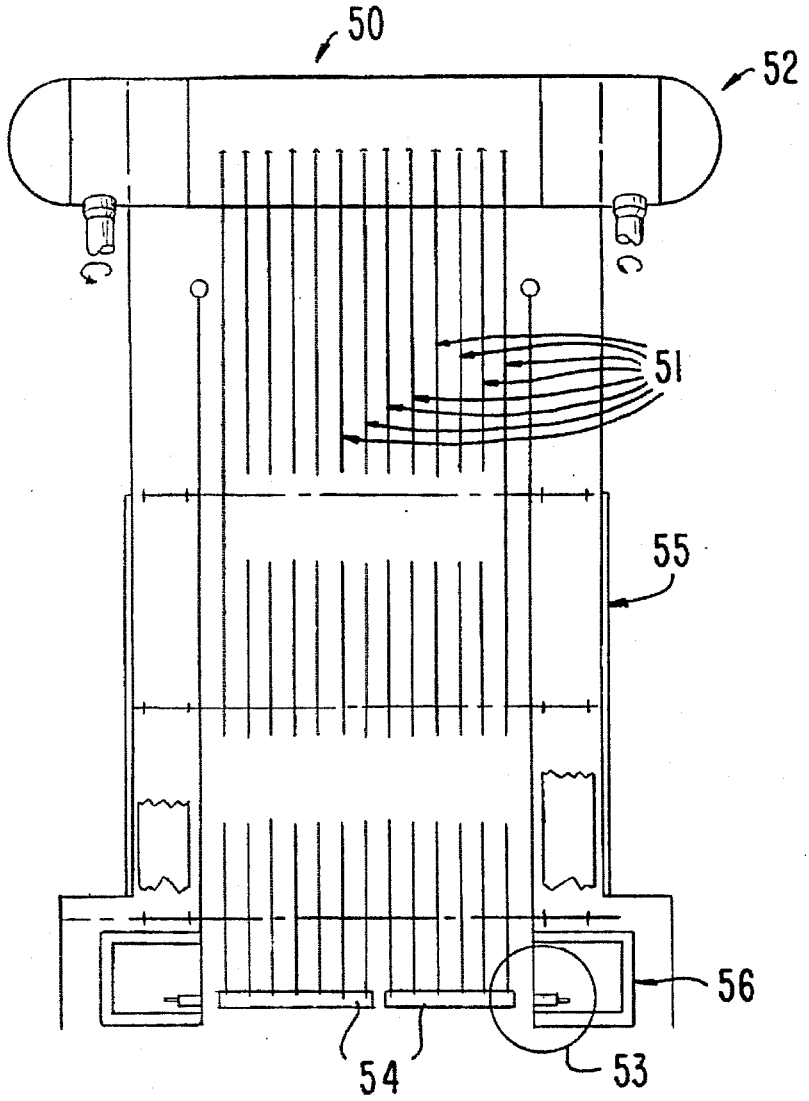
FIGS. 6 and 6*a* show a more detailed elevational view of a heat exchange tube unit and rapping hammer system installation for a steam boiler.

As shown by FIG. 6, a steam boiler unit 50 includes multiple vertical tubes 51 which are connected to an upper steam drum 52 and to lower header 54 within a casing 55. An impact rapping stem 53 is attached onto or in contact with at least one end of the lower header 54. A single impact rapping hammer assembly is aligned with the rapping stem 53 within an enclosure 56. The hammer assembly rotatable shaft and the shaft bearings are installed outside the boiler walls 55, and the only element which penetrates the boiler walls is the impact stem 53 which is directly in contact with the rapping headers 54.

Figure 6A:
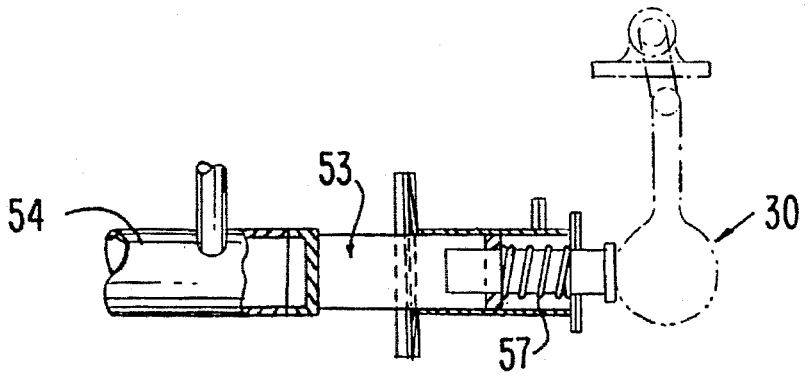

As shown in greater detail by FIG. 6*a*, the rapping hammer 30 strikes the rapping stem 53, which is attached to or in contact with the lower header 54. In case of the stem contacting the header, if desired, the rapping stem 53 can be spring-loaded by a helical spring device 57 provided around stem 53, so as to retract following impact of the hammer 50.

During operations, the rapping hammer system rotatable shaft with the rapping hammers is usually stationary, but are rotated during the tube rapping operation only. During the rapping operation, the shaft is rotating at constant speed in a range of 0.5–2 revolutions per minute, depending upon the number and spacing of hammers attached onto the shaft. For 12 or 16 rapping hammers, the circumferential spacing of subsequent hammer is 30 degrees or 22.5 degrees, respectively, in a typical arrangement. The tube cleaning process consists of a number of cleaning cycles, so that during each cleaning cycle each header would be rapped or impacted. The number of impacts per header is a function of the type of deposits which are to be removed from the tubes. In one cleaning cycle, 5–15 impacts per header would be typically used. The frequency of the cleaning cycles is determined, based on the actual tube cleaning need for a particular heat exchanger installation.

The header impact stems which are exposed to the high temperature inside the boiler walls are made of high strength, high yield metal materials, such as Hastelloy or equivalent. It is important to limit the contact stresses from the impacts on the header stem to be below the metal yield point. Components used on the outside of the boiler walls can be made of carbon steel as they are not exposed to high temperatures. The criterion for the contact or impact surfaces is that maximum contact stresses should not exceed about 80% of yield stress of the contacting materials at the operating temperature.

This invention will be further described by the following example, which should not be construed as limiting in scope.

EXAMPLE

A rapping hammer system is provided in which a plurality of hammers are pivotably attached onto an elongated rotatable shaft. The hammers are each pivotably attached to a radial arms which are spaced apart from each other along the shaft length, the radial arms being oriented at an increasing circumferential angle of 20°–60° with the adjacent radial arm. Important physical and operational characteristics of a typical rapping hammer system are provided below:

| | |
|---|---|
| Hammer arm length, in. | 12 |
| Hammer weight, pounds | 30 |
| Circumferential angle between adjacent arms, deg. | 30 |
| Spring device rate, lbs/inch | 150 |
| Rotary speed of shaft, rpm | 1 |
| Impact header stem diameter, in. | 8.5 |

It will be understood that when the rapping hammer is lifted upwardly by rotation of the radial arm by the rotatable shaft, the rapping hammer will fall rapidly by force of gravity from its uppermost elevation and shrike at high velocity against the end of the header impact stem and then rebound away from the header, thereby producing vibrations in the multiple tubes attached to the header. However, after its initial rebound the hammer will then move against the restraining action of the spring device which will substantially prevent the hammer from repeatedly striking the header stem and undesirably counteracting and minimizing the vibrations initially established or set up in the tubes.

Although this invention has been described broadly and in terms of a preferred embodiment, it will be understood that modifications and variations can be made all within the scope as defined by the following claims.

I claim:

1. A rapping hammer system for rapping and vibrating heat exchanger tubes to clean outside surfaces of the tubes, the system comprising:

an elongated rotatable shaft (20) supported by at least two stationary bearings (22);

a plurality of radial arms (18) each rigidly attached to said shaft (20) in a spaced-apart relationship, each said radial arm (18) being rigidly attached substantially perpendicular to said shaft (20) at a successively increasing circumferential angle relative to a preceding adjacent arm (18);

a rapping hammer unit (14, 15) pivotably attached to each said radial arm (18) at its outer end;

a spring device (26) attached to each said radial arm (18), said spring device (26) being arranged so as to contact and exert a restraining force on rapping motions of each said hammer unit (14, 15) relative to said radial arm (18); and means for rotating said shaft (20) and the attached rapping hammer units (14, 15), whereby the rapping hammers can strike against an exposed end of an impact stem (13) attached to or in contact with a header (12) of a tubular heat exchanger unit (10) and repeated strikes of the rapping hammer (14) against the impact stem are substantially prevented by the spring device (26).

2. A rapping hammer system according to claim 1, wherein said radial arms are oriented radially outwardly from said shaft at an increasing circumferential angle of 20°–60° relative to the preceding adjacent arm.

3. A rapping hammer system according to claim 1, wherein each said spring device is rigidly attached at one end to said radial arm and the spring device other end acts against an elongated bar of the hammer unit so as to substantially prevent subsequent rapping contact of the hammer on the impact header after the initial contact of the hammer.

4. A rapping hammer system according to claim 1, wherein each said rapping hammer unit has total weight of 20–40 pounds and a length of 10–20 inches.

5. A rapping hammer system according to claim 1, wherein said spring device attached onto said radial arm includes a spacer means and has a spring rate of 100–500 pounds/inch.

6. A rapping hammer system according to claim 1, wherein said rotatable shaft has 6–18 radial arms and rapping hammers spaced apart along the shaft, and each successive radial arm has a circumferential angle of 60–20 degrees respectively greater than the preceding radial arm.

7. A rapping hammer system according to claim 1, wherein said spring device utilizes a leaf type spring.

8. A rapping hammer system according to claim 1, wherein said spring device utilizes a compression type spring.

9. A rapping hammer system according to claim 1, wherein said spring device utilizes a torsion type spring.

10. A rapping hammer system according to claim 1, wherein said rotatable shaft and rapping hammers are provided within an enclosure located at a lower end of a heat exchanger tube unit.

11. A rapping hammer system for rapping and vibrating tubes of heat exchangers so as to remove undesired deposits from external surfaces of the tubes, the system comprising:

an elongated rotatable shaft (20) supported by at least two stationary bearings (22);

a plurality of radially extending arms (18) each rigidly attached to said shaft (20) in a spaced-apart relationship, each said radial adjacent arm being rigidly attached substantially perpendicular to said shaft (20) but at a successively increasing circumferential angle of 20°–60° relative to a preceding adjacent arm (18);

a rapping hammer unit including a hammer weight (14) and a bar (15) pivotably attached to each said radial arm (18) at its outer end;

a leaf type spring device (26) rigidly attached to each said radial arm (18) and arranged so as to contact and exert a restraining force on rapping motions of each said hammer unit (14, 15), so as to substantially prevent subsequent rapping contact of the hammer (14) on a header stem (13) after the hammer initial impact; and means for rotating said shaft (20) and attached rapping hammers (14), whereby the rapping hammers (14) can fall by gravity and repeatedly strike against an exposed end of the impact header stem (13) of a tubular heat exchanger unit (12) and repeated strikes of the rapping hammer unit (14, 15) against the impact stem (13) are prevented by the spring device (26).

12. A method for cleaning external surfaces of multiple tube units by utilizing a rapping hammer system, said method comprising;

(a) providing a plurality of rapping hammers pivotably attached to an elongated rotatable shaft along the length of the shaft, said hammers each being pivotably attached to a radial arm rigidly attached onto the shaft at successively increasing circumferential angle;

(b) rotating said shaft and lifting the rapping hammers to their uppermost position from which they fall by gravity and each hammer strikes against an impact stem of a heat exchanger unit containing multiple tubes, and producing vibrations in tubes of the heat exchanger unit so as to remove deposits from external surfaces of the tubes; and (c) restraining each said rapping hammer against subsequent impacts against the impact stem.

13. A tube cleaning method according to claim 12, including rotating said shaft at 0.5–2 revolutions/minute so that each hammer impacts the impact stem for producing vibrations in the tubes.

14. A tube cleaning method according to claim 12, including operating said rotatable shaft intermittently for 5–15 impacts per tube impact stem.

* * * * *